United States Patent [19]

Oehler

[11] 4,267,755

[45] May 19, 1981

[54] FUR-CUTTING APPARATUS

[75] Inventor: Hermann Oehler, Freudental, Fed. Rep. of Germany

[73] Assignees: Komet Stahlhalter- und Werkzeugfabrik Robert Breuning GmbH, Besigheim; Oehler Maschinenbau GmbH, Ludwigsburg, both of Fed. Rep. of Germany

[21] Appl. No.: 125,014

[22] Filed: Feb. 27, 1980

[30] Foreign Application Priority Data

Mar. 7, 1979 [DE] Fed. Rep. of Germany ... 7906315[U]

[51] Int. Cl.[3] ..... B26D 7/06

[52] U.S. Cl. ..... 83/423; 83/431; 83/474; 83/659; 83/915

[58] Field of Search ..... 83/112, 113, 161, 409, 83/431, 423, 471, 474, 495, 505, 506, 659, 915

[56] References Cited

U.S. PATENT DOCUMENTS 2,154,256 4/1969 Zimmerman ..... 83/423

*Primary Examiner*—J. M. Meister

*Attorney, Agent, or Firm*—Blanchard, Flynn, Thiel, Boutell & Tanis

[57] ABSTRACT

A circular-knife roller having several side-by-side arranged circularly shaped knives provided in a fur-cutting machine. A porcupine is arranged below the circular-knife roller and the axis of rotation thereof is parallel to the axis of the circular-knife roller. The porcupine grips with its needles the fur to be cut and presses same against the knives. A rake with elongated prongs is arranged on the outlet side of the porcupine, the free ends of which prongs extend between the needles. The rake is pivotally supported about an axis which is parallel with respect to the porcupine axis. The rake is driven by a gearing which is arranged between the porcupine axis and the pivot axis for the rake so that the free ends of the prongs perform a substantially radially outwardly and inwardly directed movement relative to the porcupine to effect a release of the fur from the tips of the needles.

10 Claims, 3 Drawing Figures

III
4
5
7
B
6.
12
12a
M
21
11
3a
2
3
2a
19
15
16
10
20
14
β1
13
M
9.
8
10a
III

FUR-CUTTING APPARATUS

FIELD OF THE INVENTION

The invention relates to a fur-cutting apparatus for cutting of fur into strips, which fur extends downwardly, comprising a circular-knife roller, a porcupine, which is arranged below the circular-knife roller, with long, radially aligned needles which penetrate through the fur and which extend between the circular knives and a rake which is arranged on the outlet side of the porcupine with elongated prongs, the free ends of which project between the needles and release the fur from the tips of the needles.

BACKGROUND OF THE INVENTION

In such a conventional fur-cutting apparatus (as it is described approximately in German Pat. No. 1 410 336), the rake is arranged rigidly. It has been proven that in spite of this rake, which actually is supposed to wipe the cut fur strips off from the tips of the needles, the fur strips are caught on the tips of the needles, which is particularly the case with long-hair furs. The caught fur strips are then carried along by the porcupine and are pulled between the prongs. In such a case, the apparatus must then be stopped and the strips of fur must be pulled out individually by means of a suitable tool and must be released from the needles. This is a time-consuming operation, especially since the individual cut strips of fur have only a width of approximately 4 to 6 mm. and a plurality of such strips of fur is arranged side-by-side. Also the strips of fur, if they are caught on the porcupine, are not placed, as desired, exactly parallel to one another on a carrier plate. However, this parallel placement is important for the further processing of the strips of fur.

The basic purpose of the invention is to provide a fur-cutting apparatus of the above-mentioned type, in which the cut strips of fur are reliably released from the porcupine and are placed perfectly parallel to one another on the carrier plate.

This is achieved according to the invention by pivotally supporting the rake about an axis which is arranged parallel to the porcupine axis and by said rake being drivable through a gearing which is provided between the porcupine axis and the rake, which gearing effects a movement of the free ends of the prongs which is substantially radially outwardly and inwardly relative to the porcupine.

Through the movable rakes, the cut strips of fur are lifted off perfectly from the tips of the needles and a catching of the strips of fur on the porcupine and a jamming of same between the prongs of the rake is thus avoided. At the same time, however, it is also achieved, that through the systematic lifting off of the strips of fur from the needles, these are placed in the desired order exactly parallel to one another on the carrier plate. Since the snagging of the strips of fur is with certainty avoided in the new apparatus, the new apparatus requires less attention by the operator and furthermore it permits also a higher operating speed. The new apparatus is also distinguished by a relatively simple design.

BRIEF DESCRIPTION OF THE DRAWINGS

The invention is discussed in more detail hereinafter with reference to one exemplary embodiment which is illustrated in the drawings, in which.

DETAILED DESCRIPTION

Figure 3:
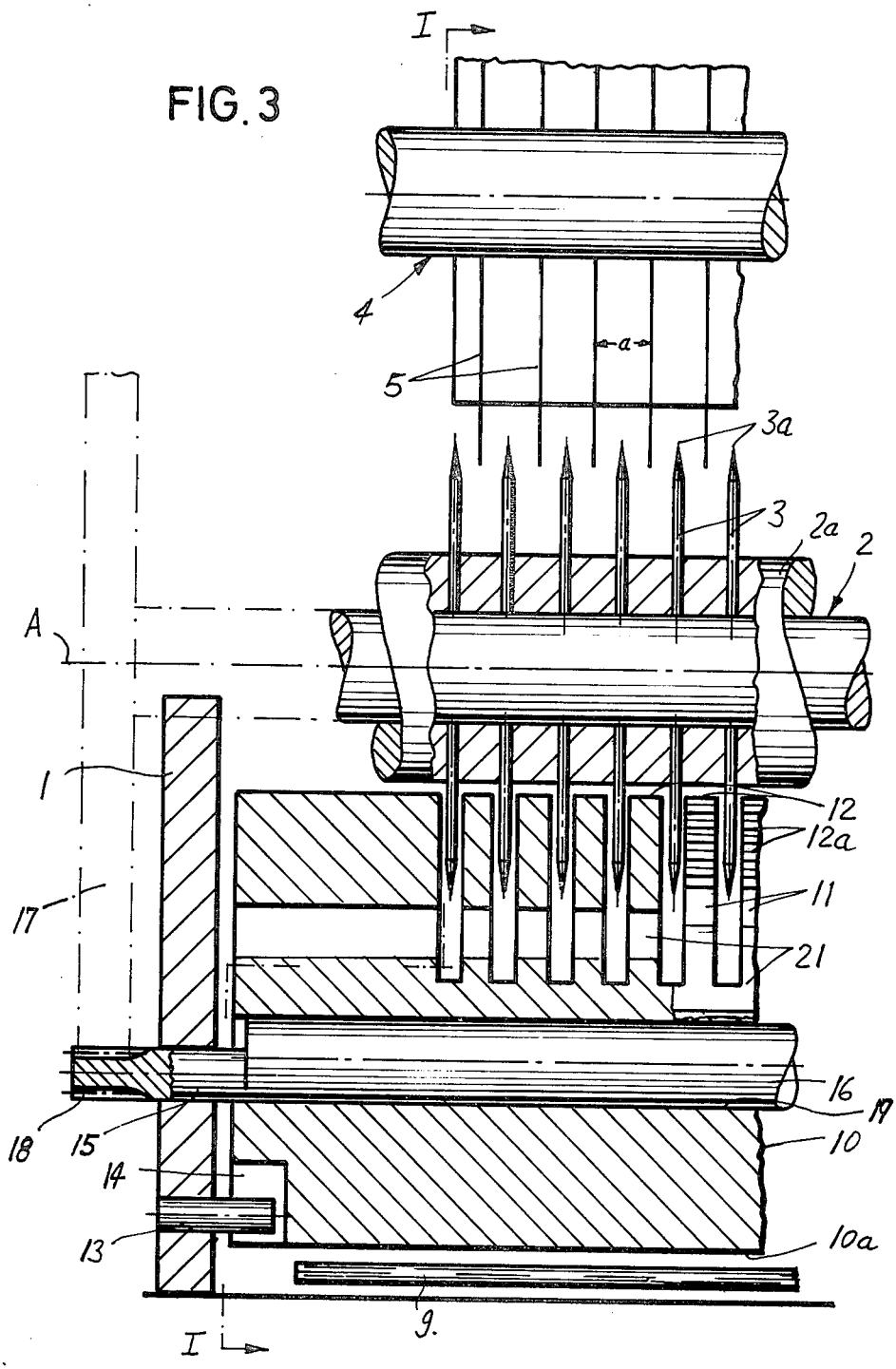
FIG. 3 is a partial longitudinal cross-sectional view taken along the line III—III of FIG. 1.

A rotatably supported porcupine 2 is drivable by means of a not illustrated hand crank in a machine frame 1, which is only partially illustrated in FIG. 3. The porcupine 2 has a plurality of radially outwardly projecting needles 3, of which in the illustrated exemplary embodiment only 24 needles are arranged in rings. Plural individual rings of needles 3 are offset axially relative to one another at evenly spaced intervals on the porcupine 2. Above the porcupine 2 there is provided a circular-knife roller 4 having a plurality of circular cutting knives 5, which project between the rings of the needles 3. The circular-knife roller 4 is driven by an electric motor which is not illustrated. The axis of rotation of the circular-knife roller 4 extends parallel to the axis of rotation A of the porcupine. The axial spacing a (FIG. 3) between the individual circular knives 5 corresponds with the desired width of the strips of fur to be cut and it is approximately 4 to 6 mm. Part of the apparatus is furthermore a machine table 6, on which the fur to be cut is supplied with the hair side facing downwardly. A pressure roller 7 which has rubber around it presses the fur to be cut against the tips 3*a* of the needles 3, which tips penetrate through the fur all the way or partially also through the leather base for the fur. By rotating the porcupine in direction B, the fur which spans the tips of the needles reaches the area of the quickly rotating circular knives 5 to effect a cutting of the fur into narrow strips of a desired width of approximately 4 to 6 mm. Part of the apparatus is furthermore a carriage roller 8 for a carriage plate 9, which carrier roller is driven in dependency of the rotary movement of the porcupine 2, on which plate the cut fur strips are to be placed parallel to one another and which plate then facilitates a transporting of the cut and sorted fur strips to the fur seamstress.

Figure 2:
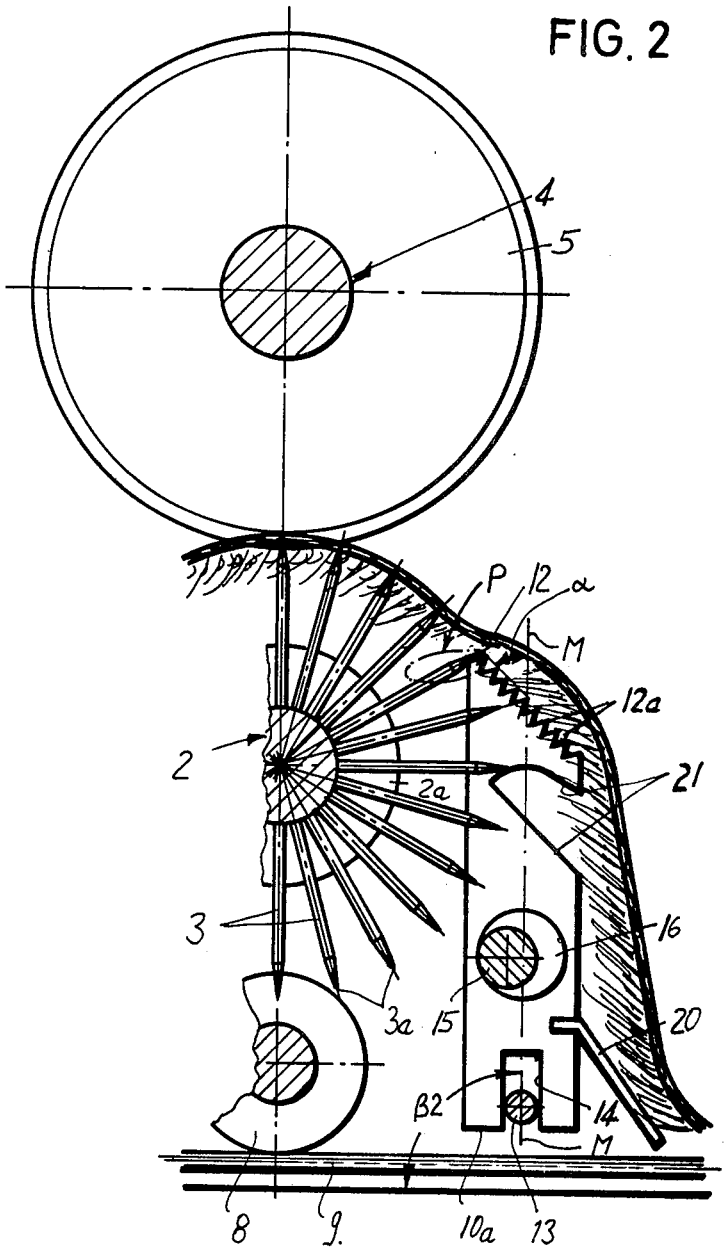
FIG. 2 is a similar cross-section with the rake moved to its outer position.

A rake 10 is provided adjacent the output side of the porcupine 2 in the region whereat the tips 3*a* of the needles 3 move approximately vertically downwardly. The rake 10 has several, parallel arranged, elongated prongs 11, the free ends 12 of which extend between the needles 3 of the porcupine 2. The rake 10 is pivotally or rockingly supported. A pivot axle 13 arranged parallel to the axis of rotation A of the porcupine 2 is preferably provided for this purpose in the region of the back or bottom part 10*a* of the rake. The pivot axle 13 consists in the illustrated exemplary embodiment of two short axially spaced stub axles 13 which are arranged in the machine frame 1. Each of said stub axles is received in a slot 14 in the back 10*a* of the rake 10 and extends longitudinally of the rake 10 and in the direction of the prongs 11. Furthermore an eccentric shaft 15 is provided, which extends parallel to the axis A of the porcupine 2 and which has an eccentric 16 thereon. The eccentric shaft 15 is driven by means of a gear 17 connected to the porcupine 2, the teeth of which are meshingly engaged with the teeth of a pinion 18 arranged on the eccentric shaft 15. The eccentric 16 is received in a hole 19 in the rake 10, the axis of the hole extending parallel to the axis of the porcupine. The hole 19 and the eccentric shaft 15 are preferably located between the back 10*a* of the rake and the prongs 11. The pivot axle 13, the longitudinal slot 14, the eccentric shaft 18 and the hole 19 form a drive arrangement effecting a driving movement of the free ends 12 of the prongs 11 relative to the porcupine 2 and which is directed substantially radially outwardly and radially inwardly about the axis of the axle 13. In reality, however, the free ends 12 of the prongs 11 do not perform a rectilinearly or arc-shaped back and forth movement, but instead, they move in an elliptical path P which is illustrated in FIG. 2 for facilitating a lifting and removal of the cut fur strips from the tips 3*a* of the needles 3 on the porcupine. In other words, during the lifting off function, the free ends 12 of the prongs 11 do not only move radially outwardly, but also in the direction of movement of the needles 3, to prevent, during the lifting off of the fur strips, a pulling of the fur in between the prongs 11.

Figure 1:
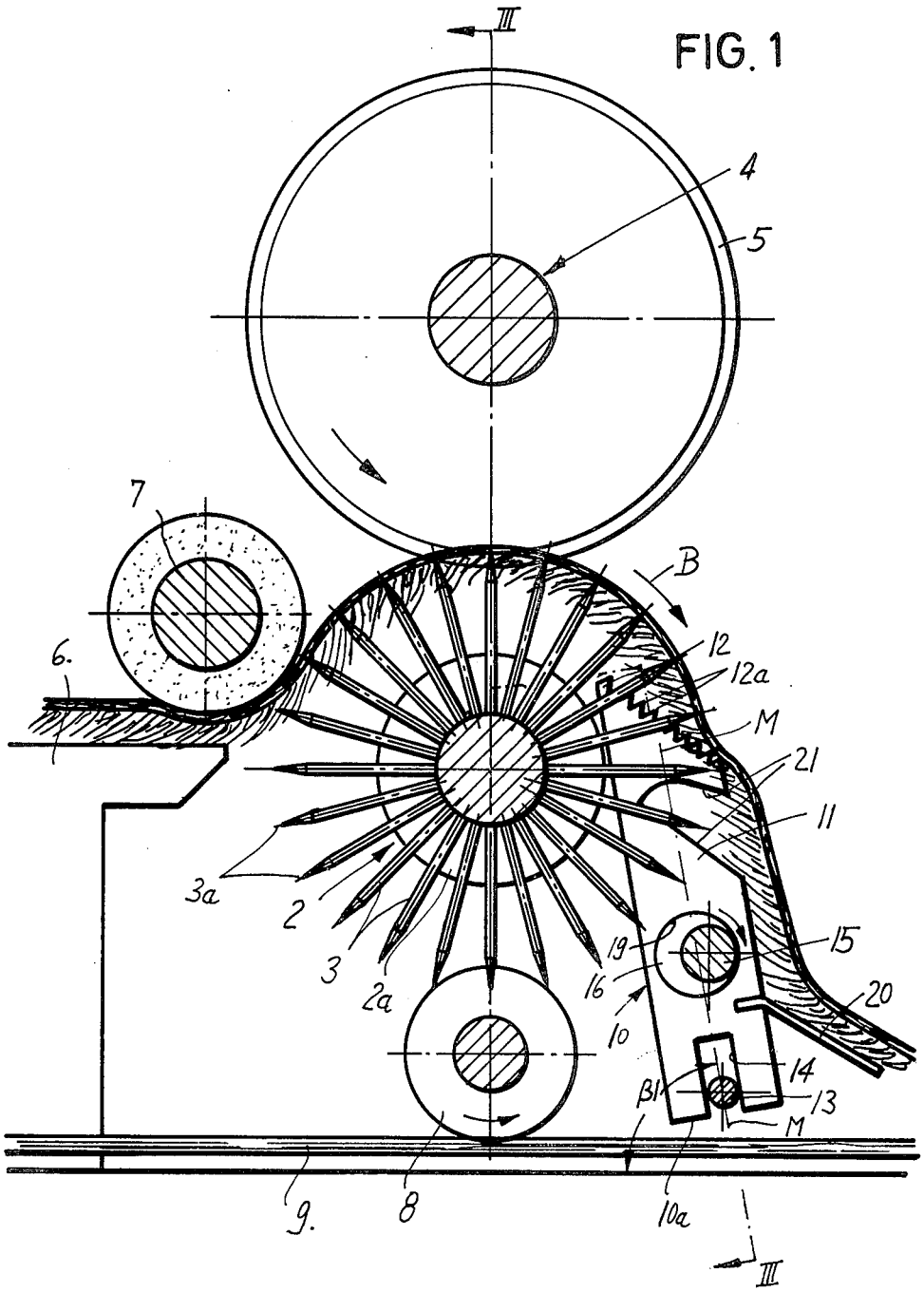
FIG. 1 is a cross-sectional view of the apparatus taken along the line I—I of FIG. 3 with the rake moved to its inner position.

The gearing 17,18 is preferably designed so that the free ends 12 of the prongs 11 undergo per rotation of the porcupine 2 at least a number of outward and inward movements, which number corresponds with the number of needles 3 which are arranged in an individual ring. Since in the illustrated exemplary embodiment 24 needles are arranged in an individual needle ring, the gearing 17,18 must be designed such that the rake 10 performs per rotation of the porcupine 2 at least 24 outward and inward movements. The gearing 17,18 is illustrated also much simplified in the drawing, because in reality intermediate gears must also be provided so that the eccentric shaft 18 is driven in the same direction of rotation as the porcupine 2. The gearing 17,18 and the gearings 13,14 and 15,19 permit the free ends 12 of the prongs 11 to be movable between an inner position (FIG. 1) which is near the core 2*a* of the porcupine 2 and an outer position (FIG. 2) which is in the range of movement of the tips 3*a* of the needles.

The plane of the free ends 12 of the prongs 11 preferably define relative to the longitudinal center plane M—M of the rake 10 an angle $\alpha$ of approximately 45°. The center longitudinal plane M of the rake 10 is swingable through an angular range $\beta 1$ and $\beta 2$ of approximately 80° to 90° relative to the vertical.

The free ends 12 of the prongs may also have several carrier teeth 12*a*, the tooth tips of which extend parallel to the axis A of the porcupine 2. These teeth can increase the lifting-off and carrying-along action.

The prongs 11 have preferably below their free ends a recess 21, which is open toward the fur-output side of the machine. In this manner, a free space is created behind or below the free ends 12 of the prongs 11, which prevents a jamming of the fur hair and thus prevents the cut strips of fur from being caught on the rake itself.

Furthermore, it is possible for the rake to have on the fur-output side near its back 10*a* a sheet-metal guide 20, which is sloped with respect to the longitudinal center plane M—M of the rake. The cut strips of fur are deflected by the sheet-metal guide toward the carrier plate 9. Since the sheet-metal guide 20 together with the rake 10 performs a rocking movement, a relative movement is created between the sheet-metal guide 20 and the carrier plate 9, which movement further favors the release of the cut strips of fur from the rake. Experience has shown that the cut strips of fur are placed always perfectly parallel side-by-side on the carrier plate 9.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a fur-cutting apparatus for cutting of furs into strips and wherein the hair side faces downwardly, comprising a circular-knife roller, a porcupine, which is arranged below a circular-knife roller having plural circular knives, with long, radially aligned needles, which penetrate through the fur and which project between said circular knives, and a rake having leaf-shaped prongs, said rake being arranged on the outlet side of said porcupine and the free ends of said rake extending between said needles and releasing the fur from the tips of the needles, the improvement comprising wherein said rake is pivotally supported about an axle which is arranged parallel with respect to the axis of rotation of said porcupine and is driven by a gearing means provided between the porcupine axis and said rake, and which gearing effects a movement of the free ends of the prongs relative to said porcupine in a direction which is substantially radially outwardly and inwardly relative to said porcupine.

2. The apparatus according to claim 1, wherein said gearing also contains a gearing, the transmission ratio of which is chosen such that the free ends of the prongs receive per rotation of the porcupine at least a number of outward and inward movements which correspond with the number of needles which are arranged in a ring.

3. The apparatus according to claim 1 or 2, wherein said free ends of the prongs can be moved between an inner position which is near a core portion of the porcupine and an outer position which is provided in the range of movement of the tips of the needles.

4. The apparatus according to claim 1, wherein said pivot axis of the rake is received in at least one longitudinal slot which extends in direction of the prongs and wherein an eccentric shaft is provided which extends parallel to said axis of rotation of said porcupine and is driven by the gearing, the eccentric of which is received in a hole in the rake, the axis of which hole extends parallel to the axis of rotation of said porcupine.

5. The apparatus according to claim 4, wherein said longitudinal slot is provided on the back of the rake and the hole between the prongs and the longitudinal slot.

6. The apparatus according to claim 1, wherein said free ends of the prongs define relative to the longitudinal center plane of the rake an angle ($\alpha$) of approximately 45° and wherein the longitudinal center plane (M—M) of the rake is swingable through an angular range ($\beta 1$, $\beta 2$) between approximately 80° to 90° relative to the vertical.

7. The apparatus according to claim 6, wherein said free ends of the prongs have several carrier teeth, the tooth tips of which extend parallel to the porcupine axis.

8. The apparatus according to claim 1, 6 or 7, wherein said prongs have below their free ends a recess which opens toward the fur-outlet side of said apparatus.

9. The apparatus according to claim 1, wherein said rake has on the fur-outlet side near its back a sheet-metal guide.

10. The apparatus according to claim 1, wherein said free ends of the prongs are arranged approximately perpendicularly with respect to the needles which are provided at the lifting-off place where the fur becomes disengaged from the needles.

* * * * *